US005244214A

United States Patent [19]

Laatikainen et al.

[11] Patent Number: 5,244,214

[45] Date of Patent: Sep. 14, 1993

[54] GAMING DEVICE

[75] Inventors: Jouko Laatikainen, Vantaa; Timo Tuomola; Kari Leino, both of Espoo, all of Finland

[73] Assignee: Rama-automaattiyhdistys, Espoo, Finland

[21] Appl. No.: 854,609

[22] PCT Filed: Jan. 2, 1991

[86] PCT No.: PCT/FI91/00003

§ 371 Date: Jun. 10, 1992

§ 102(e) Date: Jun. 10, 1992

[87] PCT Pub. No.: WO91/10219

PCT Pub. Date: Jul. 11, 1991

[30] Foreign Application Priority Data

Jan. 5, 1990 [FI] Finland ..... 900061

[51] Int. Cl.[5] ..... A63F 9/00

[52] U.S. Cl. ..... 273/460; 340/642

[58] Field of Search ..... 273/460; 340/642

[56] References Cited

U.S. PATENT DOCUMENTS

| | | | |
|---|---|---|---|
| 3,654,710 | 4/1972 | Barnard | 273/460 X |
| 3,690,665 | 9/1972 | Becker | 273/460 X |
| 3,987,424 | 10/1976 | Brouwer et al. | 340/642 |
| 4,036,500 | 7/1977 | Kiernan | 273/237 |
| 4,339,135 | 7/1982 | Breslow et al. | 273/460 X |

*Primary Examiner*—William H. Grieb

*Attorney, Agent, or Firm*—Nixon & Vanderhye

[57] ABSTRACT

This invention relates to a gaming device comprising a display panel (1) with several areas (2) to be lit up by means of sources of light, as bulbs, to give the player substantial information on the course of the game and a control unit for the control of the sources of light of the display panel (1). In order to eliminate the unreliability of the sources of light, each source of light is provided by means producing a signal indicating its working condition and the control unit is connected to receive these signals and arranged in case of a signal indicating defective operation either to turn off the gaming device or to control the operation of the gaming device in such a way that the display panel (1) area (2) containing the source of light with defective operation is not used, but the information is given to the player by means of another replacing area (2) of the display panel (1).

2 Claims, 2 Drawing Sheets

GAMING DEVICE

Figure 1:
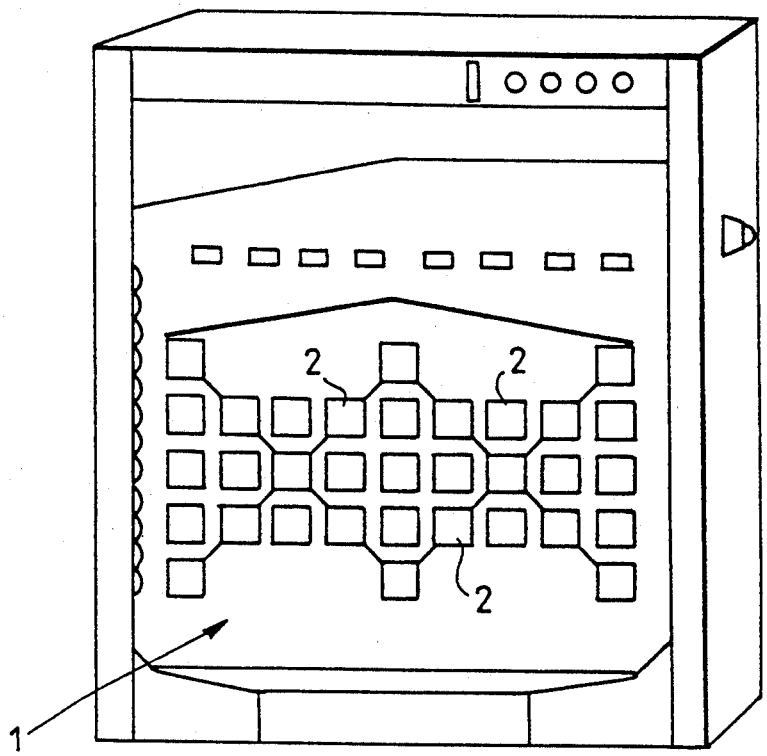

This invention relates to a gaming device comprising a display panel with several areas to be lit up by means of sources of light, as bulbs, to give the player substantial information about the course of the game and a control unit for the control of the sources of light of the display panel.

A gaming device, as a slot machine, capable of money payouts, is supposed to operate absolutely reliably both for the supervision of the run of money and for the presentation of the course cf the game to the player. If the result of the game cannot be shown reliably to the player, the player and the operator of the machine cannot rely .on the operation of the device.

In a gaming device according to this invention, the information on the course of the game is given to the player by means of display panel areas lit up by means of sources of light, e.g. normal bulbs. The reason for using bulbs is that they are easily controllable, because they can be made to light by connecting a suitable voltage to the poles of the bulbs. As voltage can be used both direct and alternating voltage. To the advantages of the bulb belongs, in addition to the simple control, a wide wave range of the emitted light, making it possible to handle different colours for instance by filtering. The wave range of LED display components primarily used as signal lamps is narrow, and therefore, filtering different colours does not correspond to the result to be achieved by means of a bulb. However, a restriction of bulbs is their relatively short lifetime. This lifetime can be limitedly increased by feeding the bulbs with a voltage lower than their rated voltage, on the one hand, and by leading a low biasing current to the bulbs when turned out, on the other hand. Such a biasing current is usually 10% of the normal value of the current of the lit up state. Nevertheless, the lifetime of a bulb cannot be increased by means of these measures more than up to 10,000 hours either.

The object of the present invention is thus to put forward a gaming device, in which bulbs can, in spite of their unreliability in principle, be utilized for the presentation of substantial information on the course of the game to the player without the reliable operation of the gaming device suffering from it.

The object mentioned above is achieved by means of a gaming device of the invention, which is characterized in that each light source is provided by means producing a signal indicating its working condition and that the control unit is connected to receive these signals and arranged in case of a signal indicating defective operation either to turn off the gaming device or to control the operation of the gaming device in such a way that the display panel area containing the light source with defective operation is not used, but the information is given to the player by means of another replacing area of the display panel.

Thus, it is not necessary to turn off the gaming device of the invention at once when one or several sources of light go out. Consequently, it is possible to increase the total operating time of the gaming device, which is advantageous for the possessor of the gaming device.

When bulbs are used as sources of light and when they are fed with direct voltage, the means for producing the signal indicating the working condition of the light source comprise a voltage divider arranged parallel with a switch feeding the light source with current and provided with a tapping. The switch can then be a semiconductor switch, which is easy to control, also by means of integrated circuits.

Figure 2A:
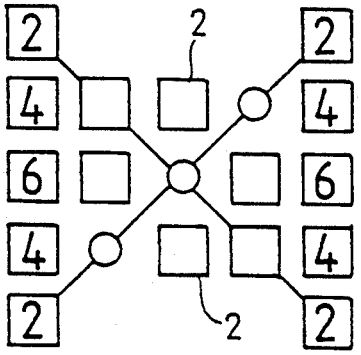
Figure 2B:
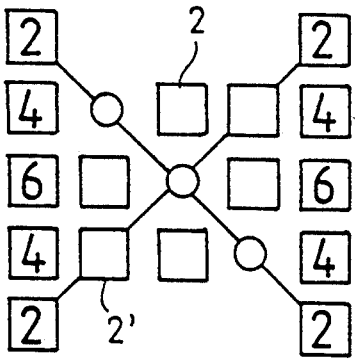
Figure 3:
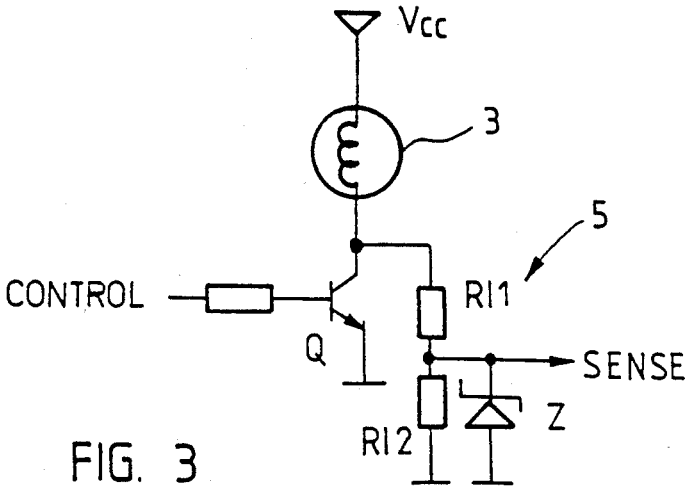
Figure 4:
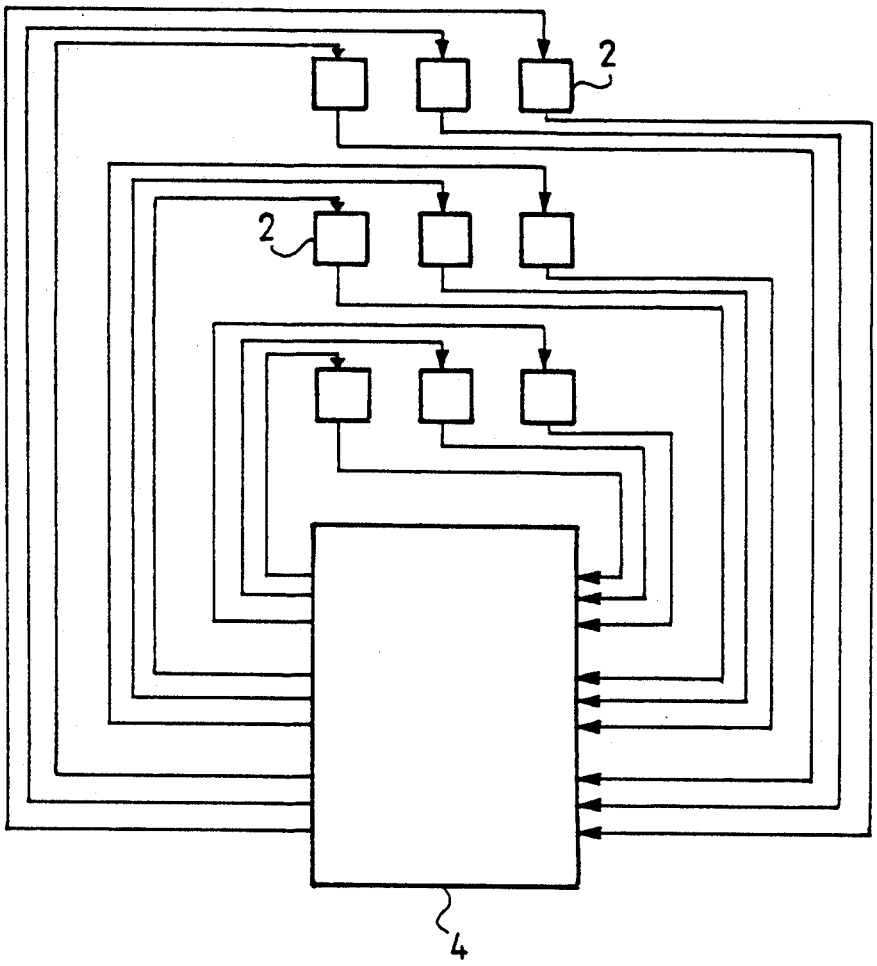

In the following, the gaming device of the invention is described in greater detail referring to the enclosed drawing, in which FIG. 1 shows a general front view of the gaming device of the invention, FIGS. 2*a* and 2*b* show one side of a display panel included in the gaming device of FIG. 1 in full working order and with a partially damaged operation, respectively, FIG. 3 shows means for the control of a source of light and for the production of a signal indicating its working condition and FIG. 4 shows a simplified circuit diagram to control the display panel areas and to collect the information on their working condition.

FIG. 1 shows a gaming device according to the invention, comprising a display panel 1 on the front side of the game, which panel has several areas 2 to be lit up by means of sources of light, e.g. bulbs, to give the player substantial information on the course of the game. The lighting of these display panel areas 2 is controlled by means of a control unit 4 shown in FIG. 4.

FIG. 3 shows a control circuit of a bulb 3 situated behind each display panel area 2, the bulb 3 being fed with a direct voltage or with a rectified voltage $V_{cc}$. Switching on and off the bulb 3 is carried out by using as a switch a transistor Q connected in series with the bulb. Parallel with this transistor Q is arranged a voltage dividing connection formed by resistances RI1 and RI2. The purpose of this voltage dividing connection is also to give the bulb 3 a suitable biasing current, which can be for instance about 10% of the rated current of the bulb. Between a tapping of the voltage divider formed by the resistances RI1 and RI2 and the earth is also connected a Zener diode Z cutting from a SENSE signal coming from this tapping such overvoltages which could damage a unit observing the SENSE signal, this unit being in practice the control unit 4. By means of the circuit of FIG. 3, the condition of the bulb 3 can be tested by preventing the control transistor Q from switching the bulb on and by measuring the voltage value of the SENSE signal. If a glow filament of the bulb is broken, the voltage level of the SENSE signal is defined according to the resistance RI2 and the Zener diode Z. If the SENSE signal controls a TTL or CMOS logic connection directly, a logic "0" state is obtained in case if the glow filament is broken. If the glow filament is in working order, the state of the SENSE signal is a certain part of the control voltage $V_{cc}$ according to the voltage division. On the basis of this, a voltage value corresponding to a logic "1" state can be dimensioned for the TTL and CMOS logic.

The capability of functioning of the transistor Q can also be measured by means of the same circuit according to FIG. 3. If the bulb 3 is found to be in order, the control transistor Q can be switched on. By the control of the transistor Q, the state of the SENSE signal is defined by the saturation voltage remaining from the transistor and by the voltage division formed by the resistances. The value of the saturation voltage is typically below V, due to which the state of the SENSE signal corresponds to the logic "0" state. Consequently, it is possible to test whether the control transistor has been damaged or whether the rest of the logic controlling the transistor is out of order. If the transistor circuit does not function, a defective function is observed when testing either the glow filament or the control transistor.

This information on the function of the bulb 3 is utilized in the gaming device of the invention at the control of the display panel areas 2 lit up by means of these bulbs. FIG. 4 shows a circuit in principle, by means of which the control unit 4 gets from each display panel area 2 information about its function, on the one hand, and controls each of these areas 2 separately, on the other hand. It shall be mentioned that FIGS. 2*a*, 2*b* and 4 show, for the sake of simplicity, only one of the two symmetrical fields of the display panel 1 of FIG. 1. By utilizing the control according to FIG. 4, the operation shown in the FIGS. 2*a* and 2*b* can be realized.

FIG. 2*a* shows the operation of the gaming device when all display panel areas 2 are in working order. Then the winning line 2—2 is lit up by lighting three lamps between fields indicated by the numeral 2 at the edge of the display panel in such a way that the line lit up begins from the left lower corner of the display panel and ends in its right upper corner. In FIG. 2*b* the corresponding situation is shown when the area indicated by the reference numeral 2' functions defectively, e.g. when its bulb is burned out. Then the control unit 4 gets information on the situation in question from the SENSE signal of this area and controls the display panel in such a manner that this damaged display area 2' is not needed. This can take place for instance in the way shown in FIG. 2*b*, in which the winning line 2—2 is lit up by lighting three lamps in line from the field indicated by the numeral 2 in the left upper corner to the field indicated by the numeral 2 in the right lower corner. Further, if one of the bulbs used e.g in FIG. 2*b* is damaged, the winning line 2—2 cannot be lit up any more. In this situation the control unit 4 either turns off the operation of the gaming device or alternatively replaces the winning line 2—2 by some other line, as for instance by 4—4.

The gaming device of the invention has been described above by means of one exemplifying embodiment and it is to be understood that the principle of the invention, i.e. to supervise the function of the lit display panel areas of the gaming device and to utilize the information obtained on the basis of this supervision at the control of the gaming device, can be used also in connection with gaming devices with a very different appearance compared with those described above. Thus the shape of the display panel or the manner in which the payouts in a slot machine for instance are indicated can be very different from what has been presented above, without deviating from the scope of protection defined by the claims enclosed, however.

We claim:

1. A gaming device comprising:

a display panel with several areas to be lit up by sources of light to give the player substantial information on the course of the game; and a control unit for the control of the sources of light of the display panel;

each source of light being provided by means producing a signal indicating the working condition of the light sources, said control unit being connected to said signal producing means to receive these signals and arranged in case of a signal indicating defective operation either to turn off the gaming device or to control the operation of the gaming device in such a way that the display panel area containing the light source with defective operation is not used, but the information is given to the player by means of another area of the display panel.

2. A gaming device according to claim 1, for producing the signal comprises a voltage divider arranged parallel with a switch feeding the source of light with current and provided with a tapping.

* * * * *